US005499962A

United States Patent [19]

Jones

[11] Patent Number: 5,499,962

[45] Date of Patent: Mar. 19, 1996

[54] LEG EXERCISE MACHINES HAVING RETRACTABLE LEG SUPPORT AND METHODS

[76] Inventor: Arthur A. Jones, 1155 NE. 77th St., Ocala, Fla. 32670

[21] Appl. No.: 270,594

[22] Filed: Jul. 5, 1994

Related U.S. Application Data

[60] Division of Ser. No. 921,112, Jul. 29, 1992, Pat. No. 5,338,274, which is a continuation-in-part of Ser. No. 909, 658, Jul. 7, 1992, Pat. No. 5,256,125.

[51] Int. Cl.[6] ..... A63B 23/04

[52] U.S. Cl. ..... 482/137; 482/192

[58] Field of Search ..... 482/100, 112, 482/113, 130, 133–139, 904; 601/33–35

[56] References Cited

U.S. PATENT DOCUMENTS

| | | | |
|---|---|---|---|
| 3,708,166 | 1/1973 | Annas | 482/137 X |
| 4,200,279 | 4/1980 | Lambert, Jr. | 482/100 |
| 4,448,412 | 5/1984 | Brentham | 482/137 X |
| 5,020,797 | 6/1991 | Burns | 482/137 X |
| 5,236,406 | 8/1993 | Webber | 482/100 |

FOREIGN PATENT DOCUMENTS

| | | | |
|---|---|---|---|
| 244070 | 3/1987 | German Dem. Rep. | 482/97 |
| 244071 | 3/1987 | Germany | 482/97 |

*Primary Examiner*—Richard J. Apley
*Assistant Examiner*—John Mulcahy
*Attorney, Agent, or Firm*—William E. Mouzavires

[57] ABSTRACT

A machine for exercising leg muscles including a movement arm rotatable about a horizontal axis, a seat for receiving a user with the legs engageable with the movement arm to rotate it in one direction about the axis, and a weight stack including a resistance weight and a vertical stack pin connectable to the resistance weight. A sprocket is connected to the movement arm to rotate with the movement arm, and a drive connection including a chain or cable is established between the sprocket and the bottom of the stack pin to raise the stack pin when the movement arm is rotated in one direction. In one embodiment a drive lever is pivotally connected to the bottom of the stack pin to raise the stack pin when the movement arm is rotated in one direction in opposition to the resistance weight. The chain is connected to an intermediate portion of the drive lever. The movement arm is provided with a convenient handle for rotating the movement arm while the user is seated.

An auxiliary support is provided to support the one leg of the user while the other is being exercised. The auxiliary support is pivotally mounted for movement between a retracted non-use position extending vertically at one side of the machine and an extended use position extending across the front of the machine.

4 Claims, 6 Drawing Sheets

LEG EXERCISE MACHINES HAVING RETRACTABLE LEG SUPPORT AND METHODS

RELATED APPLICATION

This application is a division, of application Ser. No. 07/921,112, filed Jul. 29, 1992, and now U.S. Pat. No. 5,338,274 which is a continuation-in-part of my prior application, Ser. No. 07/909,658, filed Jul. 7, 1992 and now U.S. Pat. No. 5,256,125 entitled BICEPS CURL MACHINE; the disclosure of the aforementioned application being hereby incorporated by reference into the instant application as part hereof.

BACKGROUND OF INVENTION

The present invention generally relates to methods and apparatus for exercising the legs and more particularly the muscles in the thighs including the hamstrings, quadriceps and the biceps femoris.

As for example shown in U.S. Pat. No. 4,930,768 to Lapcevic, leg exercise machines of the prior art typically utilize a weight stack to resist movement of a movement arm engaged by the legs. The weight stacks have overhead pulley and cable systems which add to the height of the apparatus as well as friction losses in the drive system between the movement arm and the weight stack. In contrast, U.S. Pat. No. 4,509,745 to Angsten discloses a leg exercise machine which actuates the weight stack from the bottom thus avoiding overhead cables and pulleys. However Angsten resorts to a hydraulic system thus sacrificing the benefits of a mechanical drive system.

OBJECTS OF INVENTION

The present invention seeks to overcome the above noted deficiencies of prior art leg-exercise machines while also providing other improvements to leg-exercise machines. It is therefore an object of the present invention to provide novel and improved methods and apparatus for exercising the legs. Included herein are such apparatus which are "user friendly" in facilitating access to or exit from the apparatus, selection of resistance weights and range of exercise movement, and positioning of the user relative to a movement arm. Further included herein is such apparatus which provides a support for one leg which may be in a cast while enabling exercise of the other leg.

A further object of the present invention is to provide a novel method and apparatus for exercising the legs against a resistance provided by a weight stack whose weight is moved upwardly from below as opposed to conventional overhead pulley and cable systems.

A further object of the present invention is to provide a novel and improved leg exercise machine incorporating a weight stack, movement arm, and a mechanical drive system in a highly compact arrangement which not only facilitates use of the machine and occupies less space but also reduces friction in the drive system.

SUMMARY OF PREFERRED EMBODIMENTS OF THE INVENTION

One disclosed embodiment of the invention is a leg extension machine for exercising the quadriceps by engaging a movement arm with the legs while bent at the knees and rotating the movement arm about a horizontal axis by straightening the legs into an extended position. Such movement of the movement arm is resisted by a weight stack located within easy reach of the user enabling the user to select a desired resistance weight and a range of movement of the movement arm while seated in the machine at the beginning or during an interval in the exercise. The seat is easily adjustable towards or away from the movement arm to suit the size of the user, and the movement arm can be easily moved by the user to facilitate entry or exit from the machine. In addition, a support is provided to allow one leg which may be in a cast to be supported while the other leg is exercised by the machine. While not in use, the support is retracted out of the way. The movement arm has a sprocket connected by a cable to the bottom of a stack pin included in the weight stack for raising the weight stack when the movement arm is rotated in one direction during exercise. Leverage is controlled and varied by a cam connected by the cable between the sprocket and the stack pin.

Another embodiment of the present invention is a seated leg curl machine for exercising the hamstring muscles. In this embodiment, the movement arm is provided with upper and lower spaced pads for receiving therebetween portions of the legs below the knees. In the start position the legs are extended with the upper pad located on one side of the leg below the knees and the lower pad on the opposite side of the legs above the ankle area. In use, the exerciser pivots the movement arm downwardly about the horizontal axis thus bending the legs about the knees, and against the resistance weight. During the exercise the upper pad on the movement arm serves to properly position the legs during the exercise. In this embodiment the movement arm is connected to the weight stack pin by means of a drive lever located at the base of the machine and pivotally connected at one end to a bottom portion of the stack pin. The opposite end of the drive lever is pivotally connected to a stationary support by a link while an intermediate portion of the drive lever is connected by a cable or chain to the movement arm such that rotation of the movement arm in one direction during an exercise will serve to lift the lever and in turn the weight stack.

DRAWINGS

Other objects and advantages of the present invention will become apparent from the following more detailed description taken in conjunction with the attached drawings in which.

DETAILED DESCRIPTION

Figure 1:
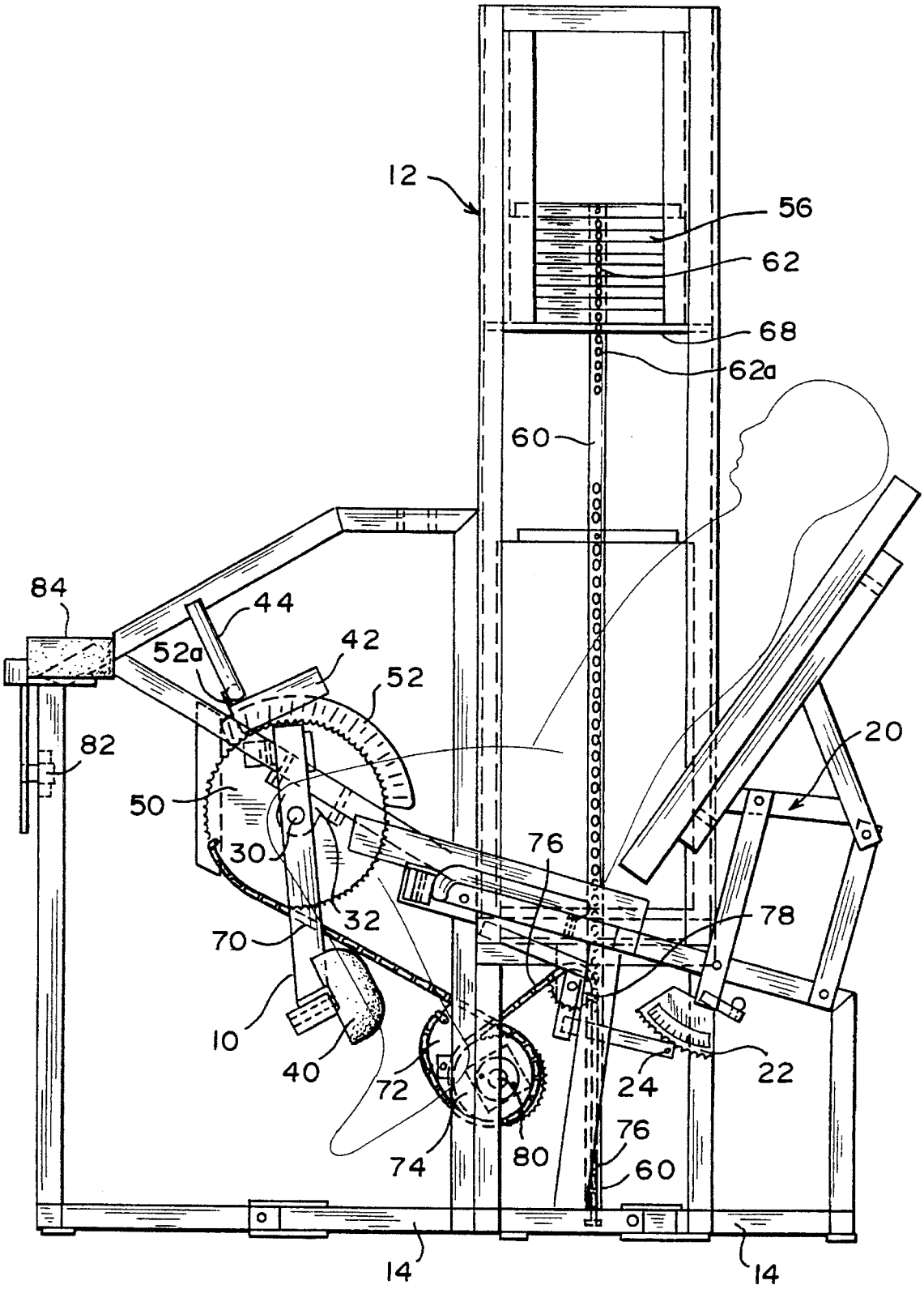
FIG. 1 is a side elevational view of the leg extension machine embodying the present invention for exercising thigh muscles such as the quadriceps, and with certain portions of the machine removed.

Referring now to FIG. 1 of the drawings, there is shown for illustrative purposes only, a leg extension machine embodying the present invention for exercising muscles of the thighs and quadriceps. FIG. 1 shows the position of the user or exerciser at the start with the legs bent at the knees and the shins engaged against a movement arm 10. To exercise, the user applies pressure against the movement arm to straighten his legs against a resistance provided by a weight stack 12. After the chosen weight or weights have been lifted, the user returns his legs to the start position while the weight descends and the exercise is repeated.

In the preferred form of the invention, the machine includes a stationary support frame 14 on which is movably mounted a seat and backrest assembly including a seat 16, backrest 18, and a linkage 20 for adjusting the seat forwardly or rearwardly. Once in the adjusted position, the seat and backrest assembly is secured by a latch or detent 22 receiving a latch pin 24 on a latch arm 26 which is conveniently operated by the hand by means of a handle 28 located generally at the level of the seat.

Located forwardly of the seat is the movement arm generally designated 10 mounted for rotation about a horizontal axis provided by a shaft 30 journalled in bearing blocks 32 secured to the stationary frame 14. The lower end of the movement arm is provided with a pad 40 for engagement by the lower shins of the user while the opposite upper end of the movement arm is provided with a counterweight 42 for balancing the movement arm about the axis 30. In addition the movement arm is provided at its upper end with a handle 44 conveniently within the reach of the user to allow the user to move the movement arm and pad 40 away from the seat to facilitate exit from the machine. Such movement of the movement arm away from the seat also facilitates access to the machine.

In order to transmit motion from the movement arm to the weight stack 12, a sprocket 50 is fixed with respect to the movement arm to rotate with the movement arm. An indicating dial 52 is provided at the periphery of the sprocket (as seen in FIG. 1) to indicate, by means of a pointer **52*a*** distance in terms of angular degrees.

In the preferred form of the invention the resistance weight stack is a compound weight stack disclosed in my U.S. Pat. No. 4,834,365 entitled COMPOUND WEIGHT SYSTEM whose disclosure is hereby incorporated by reference into the instant application as part hereof. The weight stack includes upper and lower stacks of weights, the plates of the upper stack being shown in FIG. 1 at 56. The weights of the upper and lower stacks are connectable to a stack pin which is a vertical rod 60 through means of apertures 62 in the stack pin and apertures in the weights which receive a pin in the well-known manner. The weight stack is located adjacent one side of the seat 16 to be within the reach of the user such that the user may select the desired resistance weight while seated in the machine. In addition the user may insert a pin through one of the holes **62*a* in the stack pin below the support 68** for example, to limit the stroke of the stack pin and thereby limit the range of movement of the movement arm in accordance with the desires of the user.

The resistance weight(s) 56 is moved upwardly by the exerciser through a drive system connected to the bottom of the stack pin 60 to raise the stack pin when the movement arm is rotated in the clockwise direction as viewed in FIG. 1. In the form shown in FIG. 1, the drive system includes a chain or cable 70 fixed to the periphery of the drive sprocket 50 and received about the periphery of a cam 72 with one end of the chain being fixed to the cam 72. Also fixed to the cam 72 is another and smaller sprocket 74 which has on a portion of its periphery a chain 76 fixed thereto at one end and at the other end fixed to the bottom of the stack pin 60. A redirectional sprocket 78 is provided for the chain as shown in FIG. 1. Cam 72 and its associated sprocket 74 are mounted for rotation about a horizontal shaft 80 journalled in suitable bearings fixed to the primary support structure. Cam 72 varies the leverage available for lifting the stack pin during the exercise in a well known manner.

Figure 2:
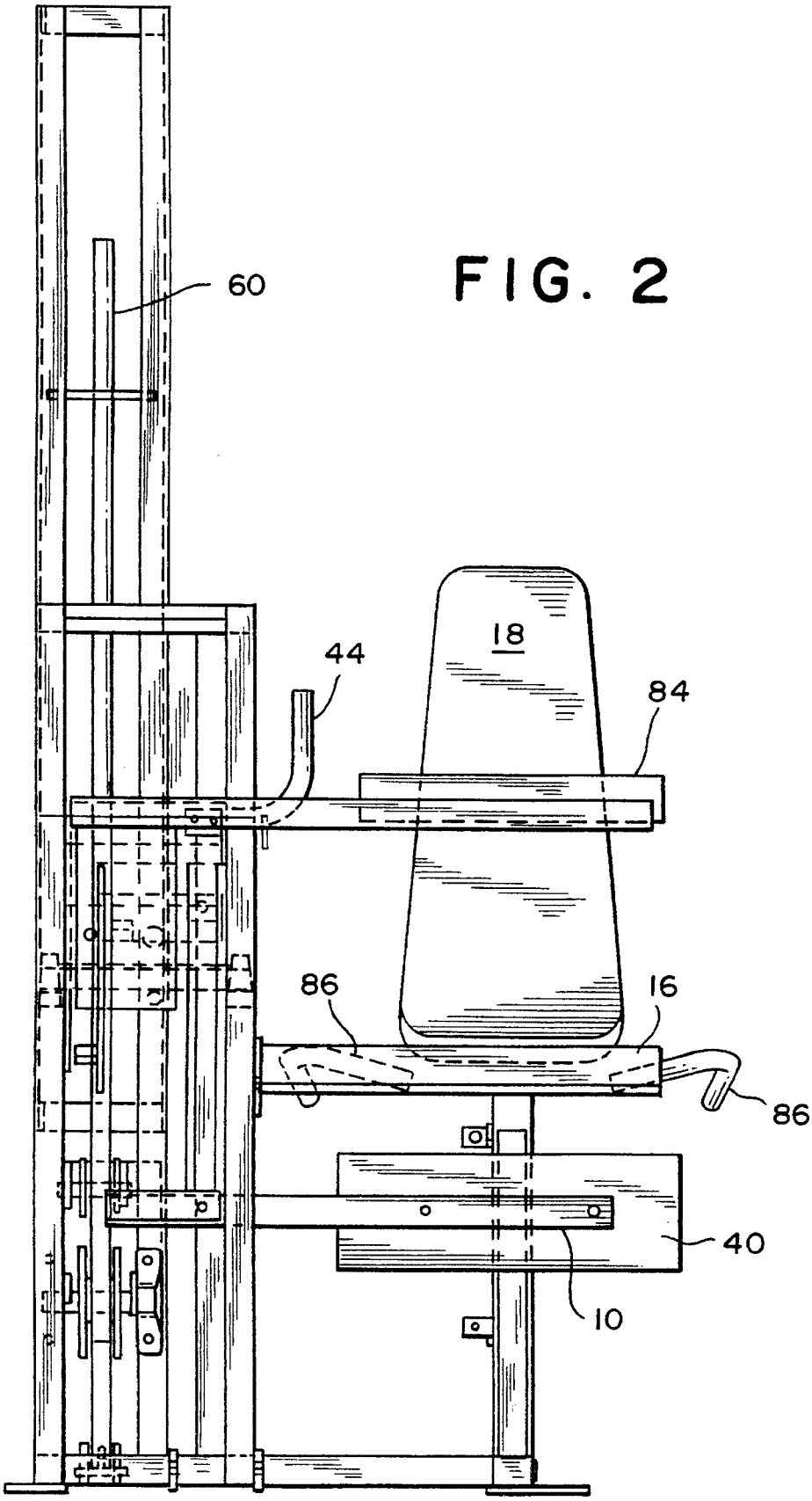
FIG. 2 is a side elevational view of the machine shown in FIG. 1.
Figure 3:
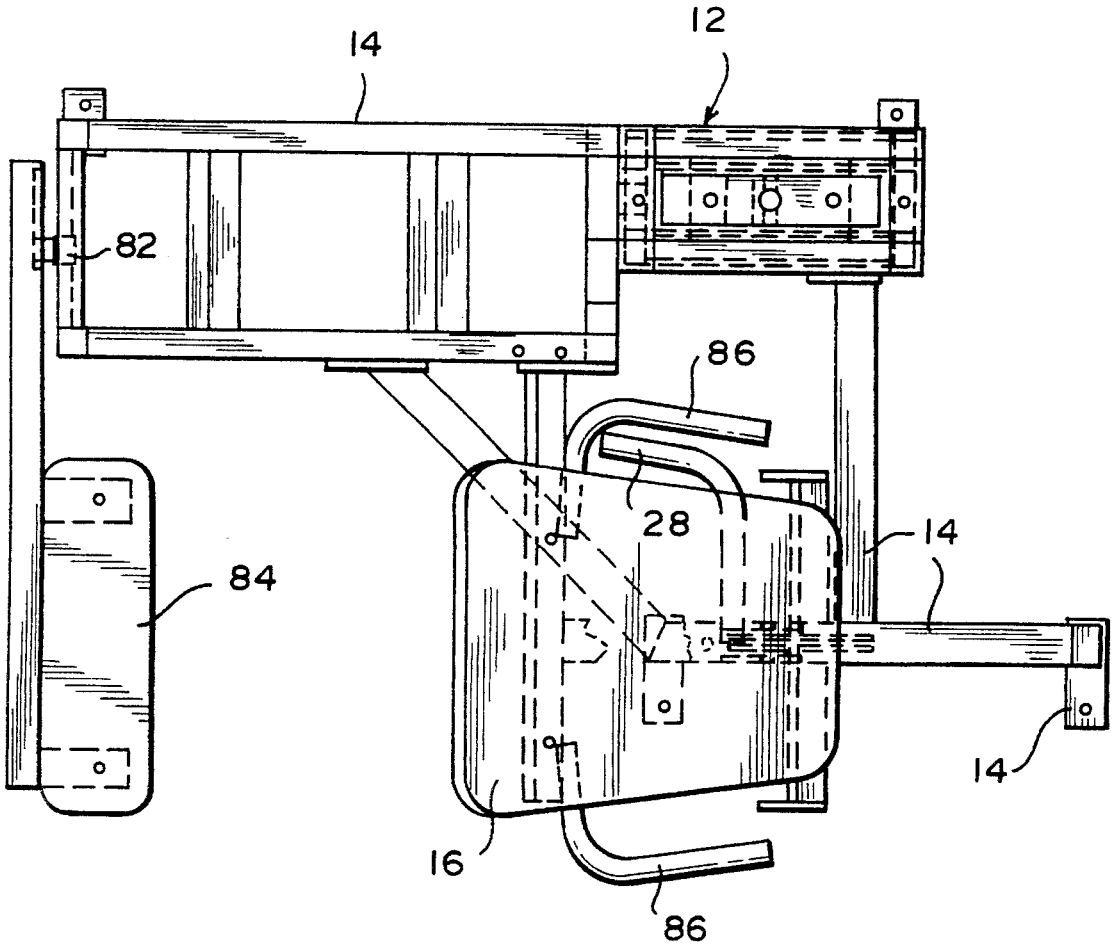
FIG. 3 is a bottom plan view of the machine shown in FIG. 1.

In the event the user has one leg in a cast and needs to exercise the other leg, an auxiliary leg support is provided in the form of an arm 84 pivotally mounted to the primary support structure to be movable between a retracted non-use position extending vertically at the front end of the machine and a use position where it extends across the front end of the machine as best shown in FIGS. 2 and 3. In the use position the user may place one of his legs on the auxiliary support pad while the other leg is being exercised. Any suitable latch or detent may be used for releasably holding the auxiliary support in the use position. The auxiliary support arm 84 is pivoted at 82 to the primary support for movement between the use and non-use positions.

In use of the machine, the user may grasp handle 44 and move the movement arm pad 40 forwardly to facilitate access to the seat 16. The user may then select the desired weight by placing a pin through the proper weight plate and into the stack pin 60. In addition the user may select a range of movement of the movement arm by inserting another pin through one of the apertures **62*a* below the support 68 to engage the support at the limit of the range. The user then grasps the handle 28 releasing the latch pin 24 and adjusts the seat 16 forwardly or rearwardly relative to the movement arm with the object of placing the knee joints in alignment with the pivotal axis 30 of the movement arm. The user then releases the handle to engage the latch pin in the appropriate aperture of the detent plate 22. The user is ready for the exercise which is conducted while the user grasps handles 86 provided on opposite sides of the seat. If the user wishes to exercise one leg at a time, the auxiliary pad 84** is moved into and secured in the horizontal use position where it will support one leg while the other leg is being exercised. If during the exercise the user wishes to change the resistance weights or the range of motion of the movement arm, he may do so while seated in the machine since the stack pin is within convenient reach.

Figure 4:
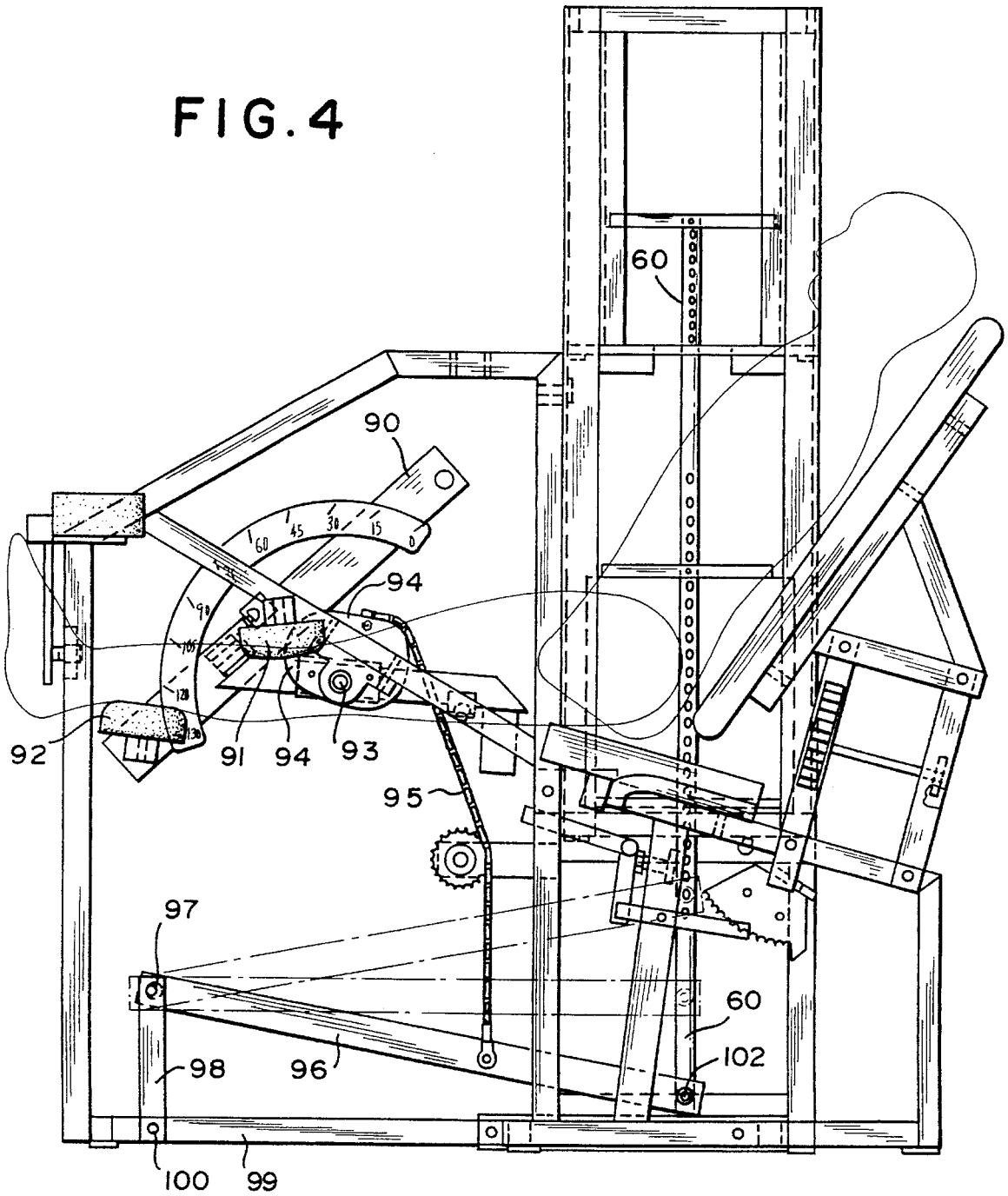
FIG. 4 is a side elevational view of a leg curl machine constituting another embodiment of the present invention for exercising thigh muscles such as the hamstrings, and with certain parts removed.
Figure 5:
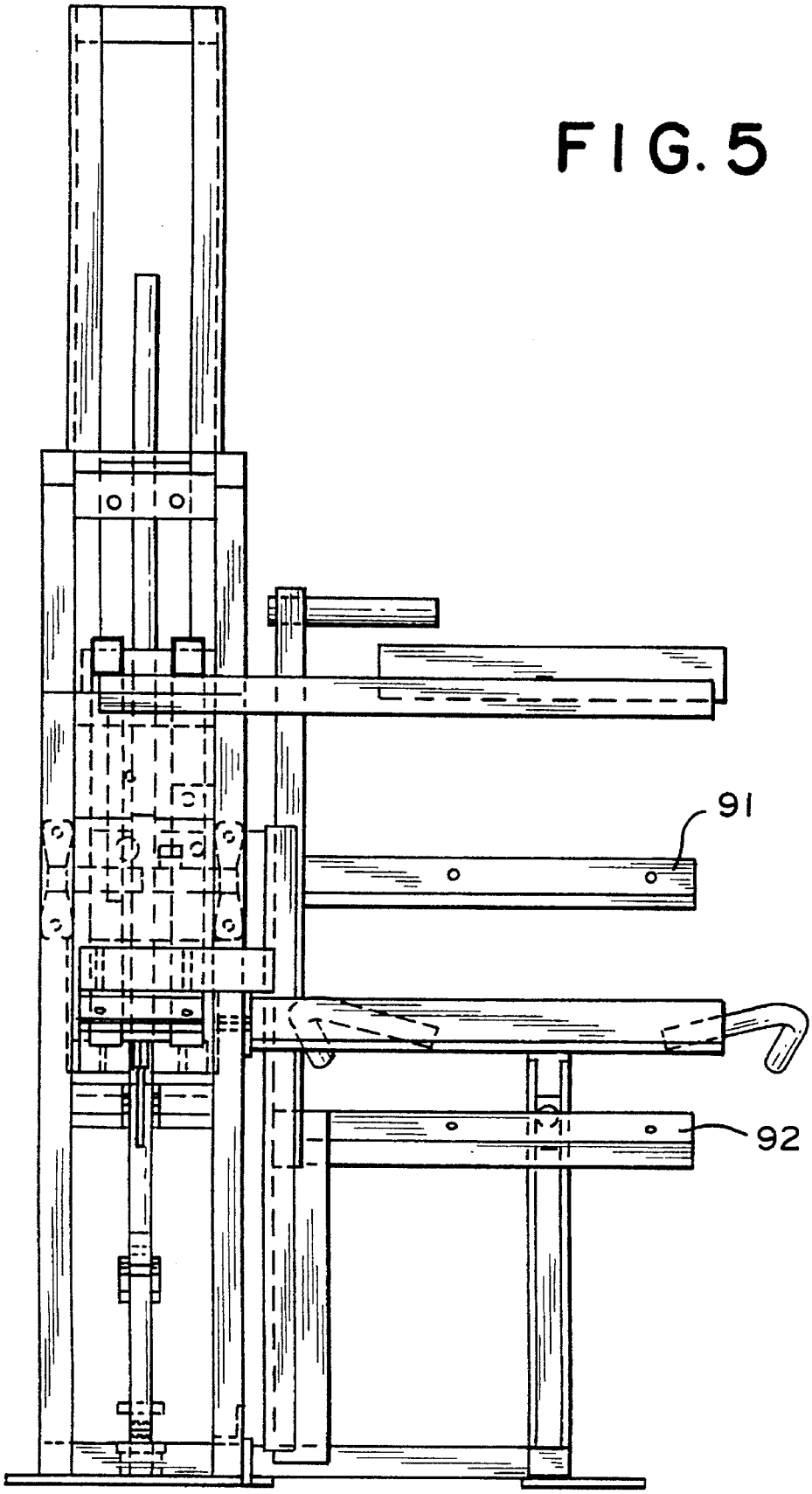
FIG. 5 is a side elevational view of the machine of FIG. 4.
Figure 6:
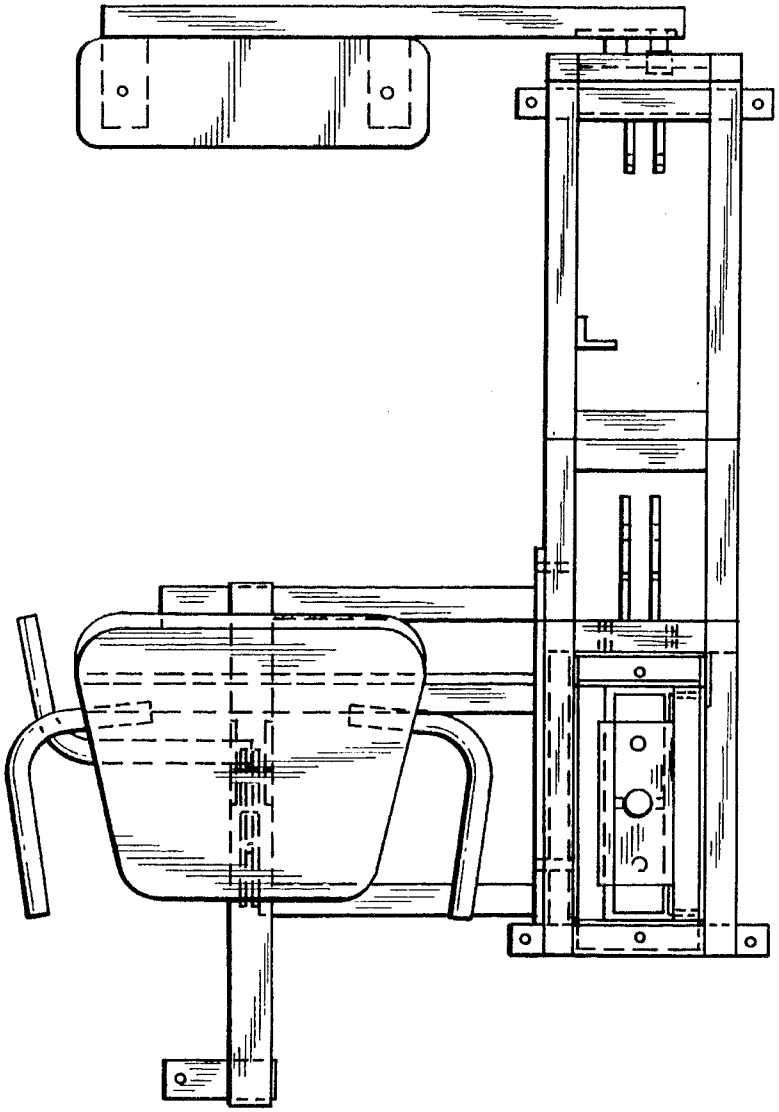
FIG. 6 is a bottom plan view of the machine shown in FIG. 4.

Referring now to FIGS. 4, 5 and 6, there is shown another embodiment of the present invention in the form of a leg curl machine. In this machine the movement arm 90 is provided with two spaced pads 91 and 92 for receiving the portion of the legs below the knees as shown in FIG. 4, which is the start position. The upper pad 91 engages the front of the legs just below the knees while the lower pad 92 engages the back of the legs just above the ankle area. To perform the exercise, the user places pressure on the lower pad with his legs to rotate the movement arm 90 about the movement arm axis 93 during which time the upper pad 91 serves to maintain the proper position of the legs with the knees generally aligned with the pivotal axis 93 of the movement arm.

The present embodiment employs a different drive system than that described above. In the present embodiment, the cam 94 is secured to the movement arm 90 to rotate with the movement arm about the axis 93 and the chain 95 is connected to an intermediate portion of a drive lever 96. One end of the drive lever is pivoted at 97 to a link 98 which in turn is pivoted at 100 to the stationary base frame 99 while the other end of the drive lever 96 is pivotally connected at 102 to the bottom of the stack pin 60 to raise and lower the same as the chain is raised and lowered. This drive system eliminates overhead pulleys and cables or chains thereby decreasing the height of the machine while also reducing friction in the drive system to increase efficiency.

What is claimed is:

1. A machine for exercising leg muscles including in combination, a movement arm rotatable about a generally horizontal axis and having a portion engageable with one or both legs of the user, a seat for receiving a user with the legs engageable with the movement arm to move the movement arm in one direction about said axis, said movement arm being located forward of the seat, a weight stack including a resistance weight and a stack pin connectable to the resistance weight, drive transmission means between the movement arm and the stack pin to raise the stack pin when the movement arm is rotated in one direction about said axis, said movement arm having a path of movement when being rotated about said axis, said machine including a support frame having a portion located forward of the seat and to one side of the path of movement of the movement arm, and an auxiliary leg support mounted to said frame portion of the machine for movement between a non-use position extending vertically at one side of the path of movement of said movement arm and spaced from the path of movement of the movement arm and a use position extending across a portion of the machine forward of the seat and above said portion of the movement arm for supporting the other leg of the user.

2. The machine defined in claim 1 including a pair of spaced upper and lower pads fixed to the movement arm to receive portions of the leg below the knees while the legs are extended, said lower pad being engageable by a leg of the user to rotate the movement arm about said axis from a position where the leg is extended to a position where the leg is bent at the knee, said auxiliary support being located above said upper pad when the auxiliary support is in the use position.

3. A machine for exercising leg muscles including in combination, a movement arm rotatable about a generally horizontal axis between upper and lower positions and having a portion engageable with one or both legs of the user for moving the movement arm between said upper and lower positions, a seat for receiving a user with the legs engageable with the movement arm to move the movement arm in one direction about said axis, said movement arm being located forward of the seat, resistance means for opposing movement of the movement arm in said one direction, drive transmission means between the movement arm and the resistance means to move the resistance means when the movement arm is rotated in said one direction about said axis, said movement arm having a path of movement when being rotated about said axis, said machine including a support portion located forward of the seat and to one side of the path of movement of the movement arm, and an auxiliary leg support mounted to said support portion of the machine for movement between a retracted non-use position at one side of the path of the movement arm spaced from the path of movement of the movement arm and an extended use position extending across a front portion of the machine forward of the seat and above said portion of the movement arm when in said upper position for supporting the other leg of the user, said leg support being positioned such that in the extended use position the user's leg that engages said portion of the movement arm will extend below said leg support.

4. A machine for exercising leg muscles including in combination, a movement arm rotatable about a generally horizontal axis, a seat for receiving a user with the legs engageable with the movement arm to move the movement arm in one direction about said axis, a weight stack including a resistance weight and a generally vertical stack pin movable in a generally vertical direction relative to the resistance weight, means for connecting the stack pin to the resistance weight to move the resistance weight upon movement of the stack pin, a cam connected to the movement arm to rotate therewith about said axis, drive transmission means between the cam and the stack pin to raise the stack pin when the movement arm is rotated in one direction about said axis, said drive transmission means including a drive lever having one end portion pivotally connected to the stack pin at a location below the resistance weight and having an opposite end portion pivotally connected to a stationary support on the machine, a flexible member connected to the cam to rotate with the cam and connected to the drive lever for raising the drive lever and in turn the stack pin when the movement arm is rotated in one direction about said axis, and an auxiliary support mounted to the machine at a location forward of the seat for movement between a non-use position extending vertically at one side of the machine out of a path of movement of the movement arm and a use position extending across a portion of the machine above said axis for supporting one of the legs of the user.

* * * * *